US008325119B2

(12) United States Patent
Yi

(10) Patent No.: US 8,325,119 B2
(45) Date of Patent: Dec. 4, 2012

(54) LIQUID CRYSTAL DISPLAY PANEL MODULES

(75) Inventor: Chien-Yu Yi, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 1438 days.

(21) Appl. No.: 11/905,208

(22) Filed: Sep. 28, 2007

(65) Prior Publication Data

US 2008/0204391 A1 Aug. 28, 2008

(30) Foreign Application Priority Data

Feb. 27, 2007 (TW) ..... 96106721 A

(51) Int. Cl.
*G09G 3/36* (2006.01)

(52) U.S. Cl. ..... 345/87; 345/89; 345/98; 345/100; 345/204; 345/690

(58) Field of Classification Search ..... 345/87–100, 345/204, 690
See application file for complete search history.

(56) References Cited

U.S. PATENT DOCUMENTS

| | | | | |
|---|---|---|---|---|
| 7,224,351 | B2 * | 5/2007 | Lee | 345/205 |
| 7,554,517 | B2 * | 6/2009 | Baum et al. | 345/89 |
| 8,013,818 | B2 * | 9/2011 | You | 345/87 |
| 2005/0219273 | A1 * | 10/2005 | Yi | 345/690 |
| 2006/0022923 | A1 * | 2/2006 | Tanaka | 345/87 |
| 2006/0158441 | A1 * | 7/2006 | Lee | 345/204 |
| 2007/0262941 | A1 * | 11/2007 | Jan et al. | 345/96 |

* cited by examiner

*Primary Examiner* — Quan-Zhen Wang
*Assistant Examiner* — Jennifer Nguyen
(74) *Attorney, Agent, or Firm* — Bacon & Thomas, PLLC

(57) ABSTRACT

A liquid crystal display panel module includes a display panel, a plurality of source drivers, a plurality of gate drivers, a gamma reference voltage generator and a timing controller, in which the timing controller controls operations of the gate drivers, of the source drivers and of the gamma reference voltage generator, so that the source drivers can, based on one set of gamma reference voltages, output single-color data groups to corresponding display sub-areas in the display panel, respectively.

19 Claims, 10 Drawing Sheets

LIQUID CRYSTAL DISPLAY PANEL MODULES

BACKGROUND OF THE INVENTION

1. Field of the Invention

The present invention relates to a technique in the field of liquid crystal display panels, more particularly, to a liquid crystal display panel modules.

2. Description of Related Art

As shown in FIG. 1, a schematic view illustrating a conventional liquid crystal display (LCD) panel module which comprises an LCD display panel 11, a plurality of gate drivers 121, 122, 123, a plurality of source drivers 131, 132, 133, 134, a gamma reference voltage generator 14 and a timing controller 15. The LCD display panel 11 comprises a plurality of display areas 111, 112, 113, 114, 115, 116 each of which has a red display sub-area 117, a green display sub-area 118 and a blue display sub-area 119 arranged longitudinally in sequence, wherein each of the display sub-areas 117, 118, 119 has a thin film transistor 1171 connected to the gate drivers 121, 122, 123 through gate lines 1211 and connected to the source drivers 131, 132, 133, 134 through source lines 1311.

The gamma reference voltage generator 14 is employed for providing a set of color gamma reference voltage to the source drivers 131, 132, 133, 134. For example, the gamma reference voltage generator 14, based on a red gamma curve, provides a set of red gamma reference voltage to the source drivers 131, 132, 133, 134. The timing controller 15 is provided for controlling the operations of the gate drivers 121, 122, 123, of the source drivers 131, 132, 133, 134, and of the gamma reference voltage generator 14.

As the timing controller 15 actuates the gate drivers 121, 122, 123, the thin film transistors 1171, which correspond to the gate drivers 121, 122, 123, in the display panel 11 will be turned on. Whereas when the timing controller 15 stops the gate drivers 121, 122, 123, above-mentioned thin film transistors 1171 will be turned off. Taking an example, in case the timing controller 15 actuates the gate driver 121, all the thin film transistors 1171 in the display areas 111, 112, 113, 114 of the display panel 11 will be turned on.

When the timing controller 15 actuates the source drivers 131, 132, 133, 134, the source drivers 131, 132, 133, 134 will convey display data to corresponding display sub-areas 117, 118, 119 in the display panel 11. For instance, when the timing controller 15 actuates the source driver 134 and the gate driver 121, all the thin film transistors 1171 in the display area 114 of the display panel 11 will be turned on; and that the source driver 134 outputs display data to corresponding display sub-areas 117, 118, 119 in the display area 114.

In the above-mentioned conventional panel modules, the source drivers 131, 132, 133, 134 can only provide one set of gamma reference voltage. That is to say, in terms of the display sub-areas 117, 118, 119 in the display panel 11, the shown gamma voltage takes a basis from a gamma reference voltage. This, however, makes impossible for an optimal modulation to the shown red, green and blue gamma curves. Suppose it is desirable to provide the source drivers 131, 132, 133, 134 with red, green and blue gamma reference voltages, respectively, such that the display sub-areas 117, 118, 119 may have a better color presentation, it is necessary to have triple interior gamma reference circuits in the source drivers 131, 132, 133, 134 of the conventional panel module. Under such circumstances, the circuits in the interior of the source drivers 131, 132, 133, 134 will become multiple, making a higher cost for manufacturing the source drivers 131, 132, 133, 134.

SUMMARY OF THE INVENTION

An object of the present invention is to provide a liquid crystal display panel module so as to output display data of particular colors, such that without a need to increase circuits in generating gamma reference voltage, settings to adjust gamma reference voltage based on various colors can be achieved.

Another object of the present invention is to provide an LCD panel module so as to improve the displaying characteristic of a multi-color gamma voltage, making more flexible for adjustment of the multi-color gamma voltage.

Still another object of the present invention is to provide an LCD panel module so as to enhance charge to the thin-film transistors by the source drivers.

A further object of the present invention is to provide an LCD panel module, so that through changing input locations of the source drivers and of the gate drivers, settings on multi-color gamma reference voltage can be accomplished independently without a need to change circuit design of the source drivers and of the gate drivers.

A still further object of the present invention is to provide a source driver so as to output single-color display data groups, such that settings on gamma reference voltage can be respectively adjusted based on a variety of colors, without a need to additionally design a gamma reference voltage generation circuit.

Still another object for the present invention is to provide a timing controller so as to output single-color display data groups, such that settings on gamma reference voltage can be respectively performed based on a variety of colors, without a need to additionally design a gamma reference voltage generation circuit.

To achieve the above-mentioned objectives, the present invention provides an LCD display panel module which comprises a display panel, a plurality of source drivers, a plurality of gate drivers, a gamma reference voltage generator, and a timing controller. The display panel comprises a plurality of display areas each of which has a plurality of display sub-areas. The source drivers are electrically connected with the display panel and are located at a first side of the display panel, wherein the source drivers output single-color display data groups to corresponding display sub-areas in the display panel; and wherein all the signals in each single-color display data group are of the same color display data and correspond to the display sub-areas of the same color in the display panel. The gate drivers are electrically connected with the display panel and are located at a second side of the display panel, where the first side is perpendicular to the second side. The gamma reference voltage generator is electrically connected with the source drivers. The timing controller is electrically connected with the source drivers, the gate drivers, and the gamma reference voltage generator, and controls operation of the gate drivers, of the source drivers and of the gamma reference voltage generator, such that a set of gamma reference voltage corresponding to each single-color display data group can be supplied to the source drivers from the gamma reference voltage generator.

The display sub-areas can be arrayed randomly. In an embodiment of the present invention, however, the display sub-areas can be arrayed at one direction, either longitudinally or laterally, with no limitation to the direction.

To achieve the above-mentioned objects, the present invention provides a source driver which is used in an LCD panel module having a display panel with a plurality of display areas. The source driver comprises a receiver unit, a latch register unit, a multiplexer unit, and an output buffer unit. The receiver unit is electrically connected with the timing controller, and receives multi-color display data groups from the timing controller. The latch register unit is electrically connected with the receiver unit, and registers the multi-color display data groups. The multiplexer unit is electrically connected with the latch register unit, and changes the sort and arrangement of the multi-color display data groups so as to produce single-color display data groups. The output buffer unit electrically connects the multiplexer unit with the display sub-areas, and registers the single-color display data groups which are then transmitted to corresponding display sub-areas in the display panel.

To achieve the above-mentioned objects, the present invention provides a timing controller which is used in an LCD panel module, in which the LCD panel module has a plurality of source drivers. The timing controller comprises a receiver unit, a data latch logic circuit, a data process logic circuit, and an output unit. The receiver unit receives multi-color display data groups. The data latch logic circuit is electrically connected with the receiver unit, and registers the multi-color display data groups. The data process logic circuit is electrically connected with the data latch logic circuit, and changes the sort and arrangement of the multi-color display data groups so as to produce single-color display data groups. The output unit electrically connects the data process logic circuit with the source drivers, and transmits single-color display data to the source drivers.

In an aspect of the present invention, at least one gate driver controls, longitudinally, the display sub-areas; and at least one source driver provides, laterally, single-color display data groups which correspond to the set of gamma reference voltage, to the display sub-areas.

In another aspect of the present invention, the gate drivers have an amount of output channels more than those of the source drivers.

In still another aspect of the present invention, there is a thin-film transistor in each of the display sub-areas, and the source drivers charge the thin-film transistors in a way of dual-side input.

In a further aspect of the present invention, at least one gate driver controls, laterally, the display sub-areas; and at least one source driver provides, longitudinally, single-color display data groups to the display sub-areas.

In an aspect of the present invention, the LCD panel module further comprises a storing device which is electrically connected with the timing controller. The storing device receives multi-color display data groups from the timing controller, and that the timing controller, by using the storing device, changes the sort and arrangement of the multi-color display data groups so as to transmit single-color display data groups to the source drivers.

In another aspect of the present invention, the storing device is a Synchronous DRAM (SDRAM).

In still another aspect of the present invention, the source drivers and the gate drivers are located at a longitudinal side and a lateral side of the display panel, respectively. In yet another aspect of the present invention, the source drivers and the gate drivers are located at a lateral side and a longitudinal side of the display panel, respectively.

In a further aspect of the present invention, the source driver comprises a receiver unit, a latch register unit, a multiplexer unit, and an output buffer unit. The receiver unit is electrically connected with the timing controller, and receives multi-color display data groups from the timing controller. The latch register unit is electrically connected with the receiver unit, and registers the multi-color display data groups. The multiplexer unit is electrically connected with the latch register unit, and changes the sort and arrangement of the multi-color display data groups so as to produce single-color display data groups. The output buffer unit electrically connects the multiplexer unit with the display sub-areas, and registers the single-color display data groups which are then transmitted to corresponding sub-areas in the display panel.

In a still further aspect of the present invention, the source driver further comprises a data register unit, a shift register, a converter unit, and a level shift unit. The data register unit electrically connects the receiver unit with the latch register unit. The shift register unit electrically connects the data register unit with the latch register unit. The converter unit is electrically connected with the output buffer unit. The level shift unit electrically connects the multiplexer unit with the converter unit.

In a preferred aspect of the present invention, the display panel further comprises a plurality of gate lines which are connected with the gate drivers and the display sub-areas; and the latch register unit stores the data of the amount as the data stored in the display sub-areas connected with the gate lines.

In an object of the present invention, the multiplexer unit resides in a 3:1 multiplexer, namely, one output is selected from three input sources, whereas in other aspect of the invention, the multiplexer can be of another kind of multiplexer.

In a still further aspect of the present invention, the timing controller comprises a receiver unit, a data latch logic circuit, a data process logic circuit, and an output unit. The receiver unit receives multi-color display data groups; the data latch logic circuit is electrically connected with the receiver unit, and registers the multi-color display data groups. The data process logic circuit is electrically connected with the data latch logic circuit, and changes the sort and arrangement of the multi-color display data groups so as to produce single-color display data groups. The output unit electrically connects the data process logic circuit with the source drivers, and transmits single-color display data groups to the source drivers, and thereafter the source drivers transmits the single-color display data groups to corresponding display sub-areas in the display panel.

In a still another aspect of the present invention, the timing controller further comprises a driver timing generator unit for producing timing signals to the source drivers and to the gate drivers.

In an aspect of the present invention, the display panel further comprises a plurality of gate lines which are connected with the gate drivers and the display sub-areas; and that the data latch logic circuit stores the data of the amount as the data being stored in the display sub-areas which are connected with the gate lines.

In a further aspect of the present invention, the receiver unit or the output unit supports a reduced swing differential signal interface, a transistor-transistor logic interface, or a low voltage differential signal interface.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
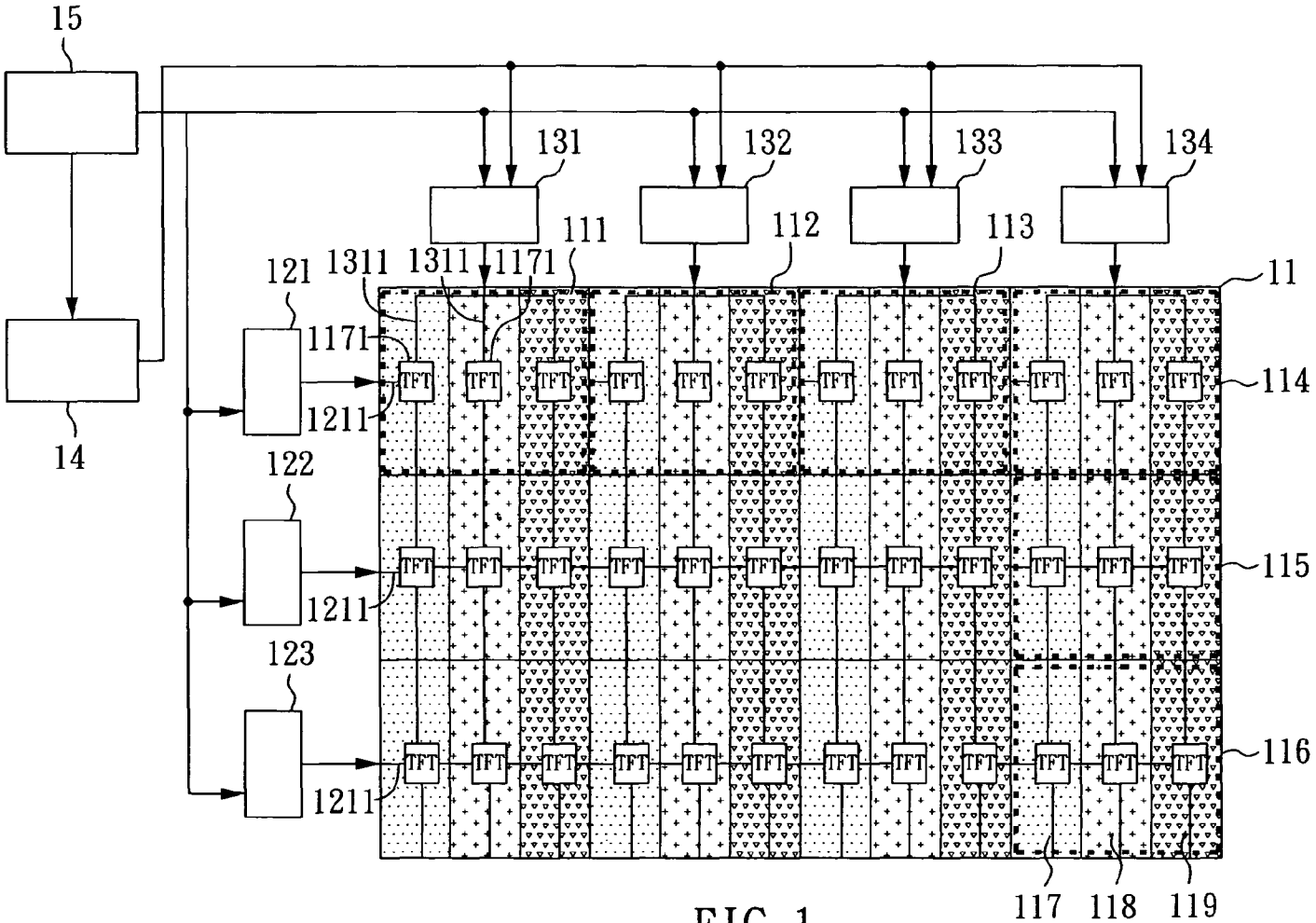
FIG. 1 (PRIOR ART)
FIG. 1 is a schematic view illustrating a conventional LCD panel module.
Figure 2:
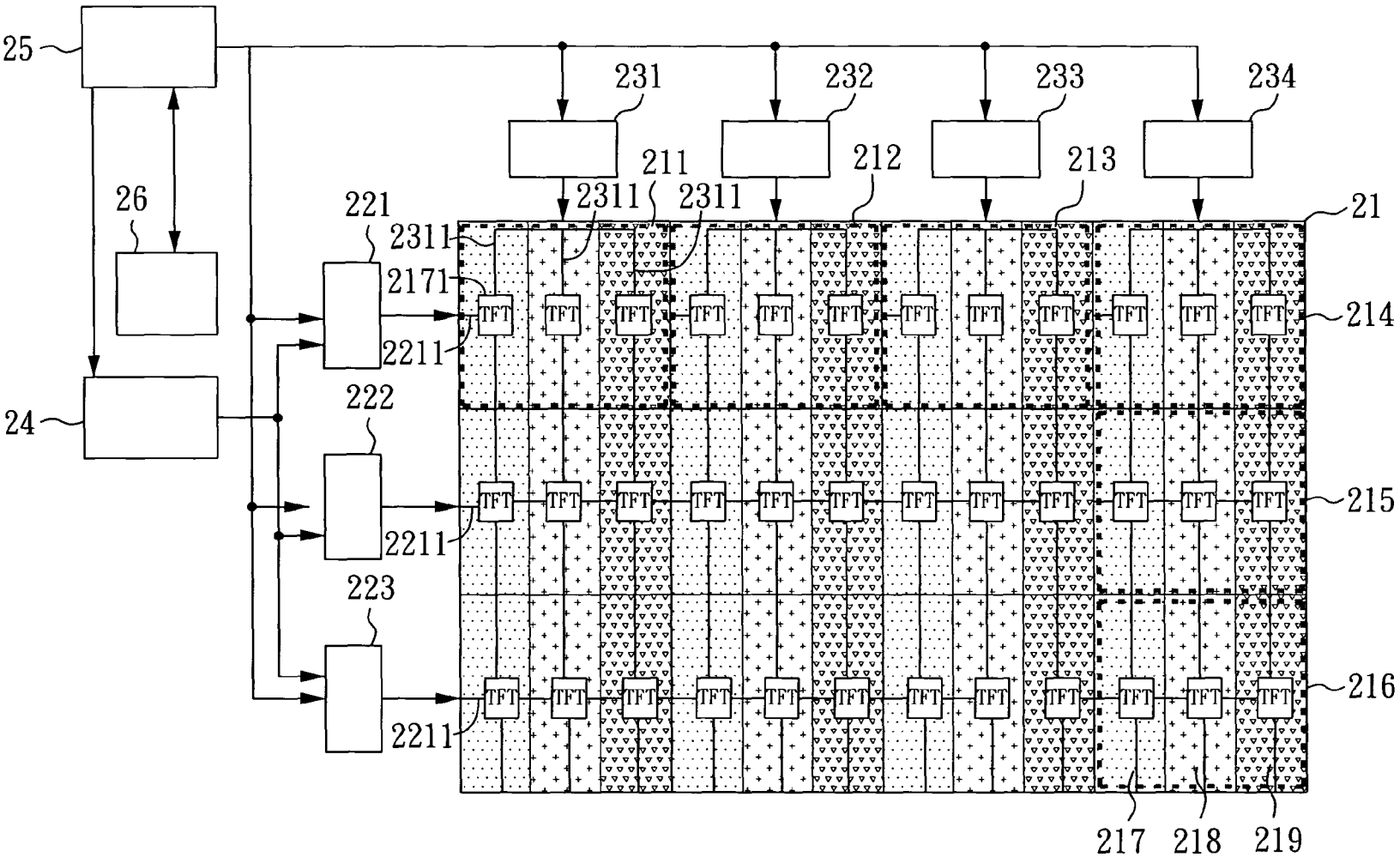
FIG. 2 is a function block diagram for an LCD panel module according to a first embodiment of the present invention.

FIG. 2 is a function block diagram for an LCD panel module according to the first embodiment of the present invention, wherein the LCD panel module comprises an LCD display panel 21, a plurality of gate drivers 231, 232, 233, 234, a plurality of source drivers 221, 222, 223, a gamma reference voltage generator 24, a timing controller 25, and a storage device 26. The LCD display panel 21 comprises a plurality of display areas 211, 212, 213, 214, 215, 216 each of which has a red display sub-area 217, a green display sub-area 218 and a blue display sub-area 219, respectively, wherein each of the display sub-areas 217, 218, 219 has a thin film transistor 2171 connected to the gate drivers 231, 232, 233, 234 through gate lines 2211 and connected to the source drivers 221, 222, 223 through source lines 2311. The layout of the thin film transistor 2171, gate lines 2211, and source lines 2311 may vary due to variable considerations, however, the present embodiment merely offers an example of the layouts.

The timing controller 25 is electrically connected with the source drivers 221, 222, 223, the gate drivers 231, 232, 233, 234, the gamma reference voltage generator 24, and the storage device 26, respectively. The gamma reference voltage generator 24 is electrically connected with the source drivers 221, 222, 223. The display panel 21 is electrically connected with the gate drivers 231, 232, 233, 234 and the source drivers 221, 222, 223, respectively.

Notice may be taken to the present embodiment, where the locations for arranging the source drivers 221, 222, 223 and the gate drivers 231, 232, 233, 234 are different from the locations for arranging conventional driving circuits. That is to say, conventionally, the gate drivers are arranged beside the display panel longitudinally; and the source drivers are arranged beside the display panel laterally, so that the action of the thin film transistors 2171 in the display sub-areas 217, 218, 219 of the display areas 211, 212, 213, 214, 215, 216 can be controlled laterally via the conventional gate drivers; and that display data groups of multiple colors mixed with red, green and blue can be provided longitudinally to the display sub-areas via the conventional source drivers.

In contrast, for the present embodiment, the gate drivers 231, 232, 233, 234 are arranged laterally beside the display panel 21, and that the source drivers 221, 222, 223 are arranged longitudinally beside the display panel 21. In addition, the gate drivers 231, 232, 233, 234 has an amount of output channels more than those of the source drivers 221, 222, 223, thereby the action of the thin film transistors 2171 in the display sub-areas 217, 218, 219 of the display areas 211, 212, 213, 214, 215, 216 can be controlled longitudinally; and that multiple-color display data groups can be provided to the display sub-areas of the lateral display areas via the source drivers 221, 222, 223. Taking an example, the gate driver 234 can control the action of the thin film transistors 2171 in the display areas 214, 215, 216 (longitudinal display areas); and that the source driver 221 can provide a group of display data to the display sub-areas 217, 218, 219 of the display areas 211, 212, 213, 214 (lateral display areas).

In the present embodiment, the timing controller 25 controls to receive display data groups mixed with a variety of colors, such as red, green and blue, from an external device (not shown, can be a display card or a processor). Thereafter, the received display data groups are registered in a storing device 26. The timing controller 25 then changes the sort and arrangement of the multi-color display data groups mixed with red, green and blue so as to produce single-color display data groups distinguished from red, green and blue, and the single-color display data groups are transmitted to the source drivers 221, 222, 223.

Since the source drivers 221, 222, 223 received the single-color display data groups, the source drivers 221, 222, 223 output a single color (i.e. red, green or blue selected in cycle or randomly) at every time section when the source drivers 221, 222, 223 output display data to the display panel 21. The single-color display data groups are then transmitted to the display panel 21 correspondingly at the display sub-areas 217/218/219 which is in responsive to the single-color display data. By using this characteristic, the timing controller 25 can control additionally the gamma reference voltage generator 24 such that a set of gamma reference voltage relevant to the output single-color can be supplied to the source drivers 221, 222, 223, so that the source drivers 221, 222, 223 can correct the gamma reference voltage for the single-color display data groups. In other words, the display data of various red, green and blue may have different gamma reference voltage for producing a variety of gamma curves, and as such, an optimal gamma correction can be achieved.

Therefore, a driving circuit formation provided from the present embodiment can perform various setting values of gamma curves on red, green and blue colors. References in this respect may be made in FIGS. 3A and 3B for explanations, wherein FIG. 3A is a schematic view illustrating operation timing for the present embodiment, and FIG. 3B is a schematic view illustrating output signals from gate drivers according to the present embodiment.

Figure 3A:
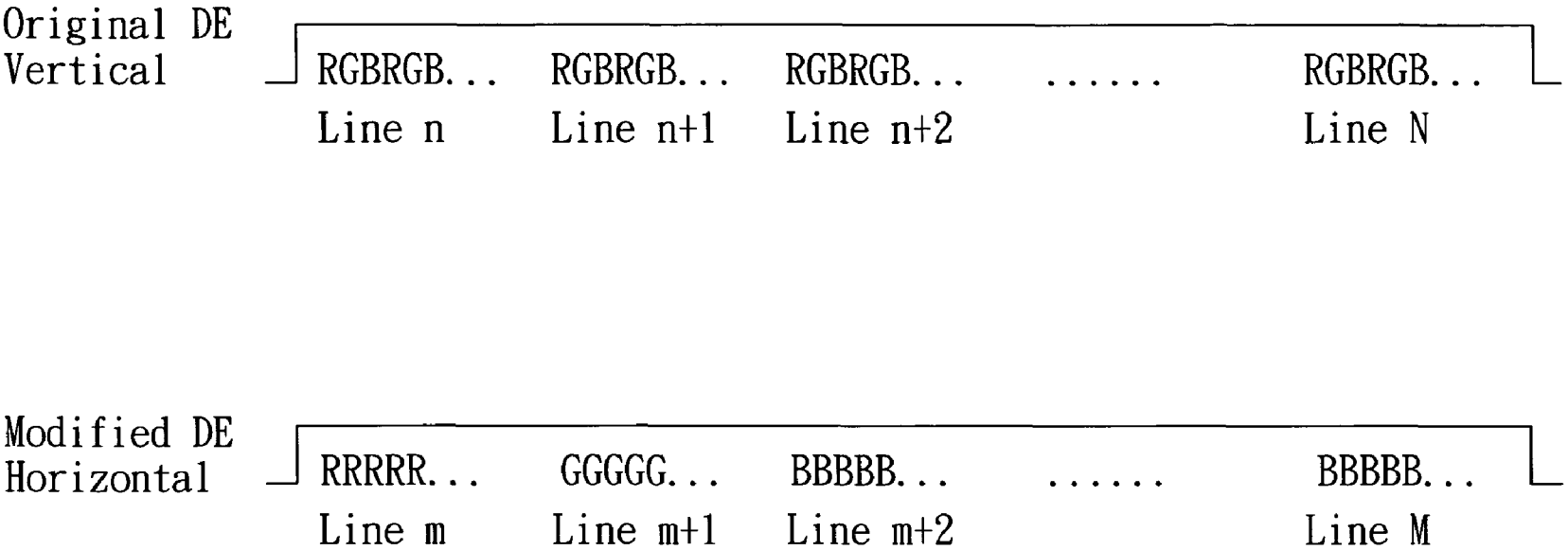
FIG. 3A is a schematic view illustrating operation timing for the first embodiment of the present invention.
Figure 3B:
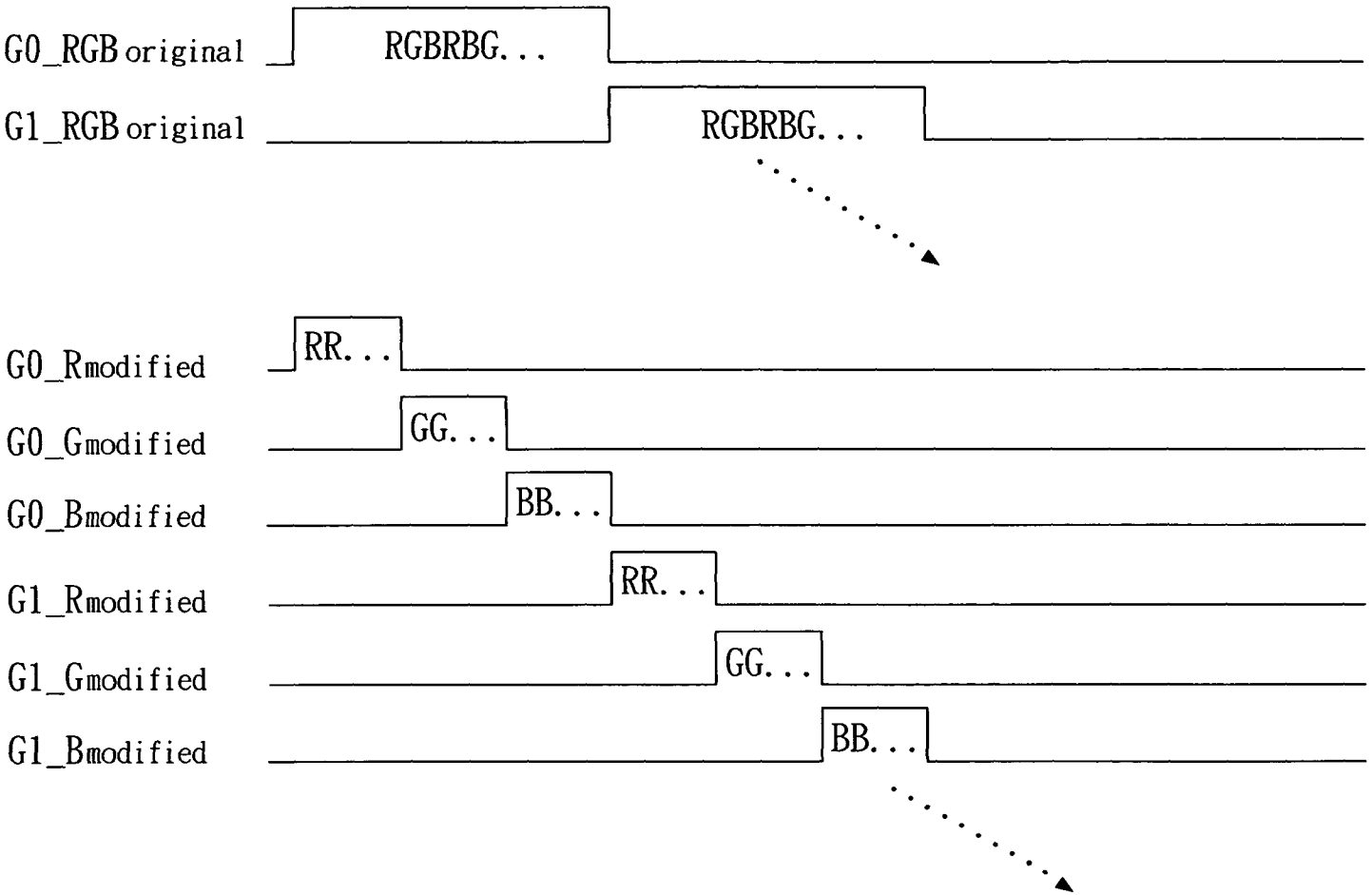
FIG. 3B is a schematic view illustrating output signals from gate drivers according to the first embodiment of the present invention.

As shown in FIGS. 3A and 3B, for the display areas 214, 215, 216 at the first time section, the timing controller 25 uses the storing device 26 to change the sort and arrangement of the display data groups mixed with multi-colors received from the external device (Original DE Vertical), i.e. the sort and arrangement for Original DE Vertical so as to produce a group of single-color display data (Modified DE Vertical), i.e. Modified DE Horizontal.

When the timing controller 25 controls the gate drivers 231, 232, 233, 234 to transmit the signals $G0_R_{modified}$~$G1_B_{modified}$ . . . for actuating the thin film transistors 2171 in the display sub-area 217 of the display areas 211, 212, 213, 214, 215, 216, red-color display data is first output to the source drivers 221, 222, 223. The timing controller 25 also controls the gamma reference voltage generator 24 such that a set of gamma reference voltage relevant to the red-color display data can be supplied to the source drivers 221, 222, 223, so that the source drivers 221, 222, 223 can output the red-color display data to the red-color display sub-area 217 of the display areas 211, 212, 213, 214, 215, 216 after a gamma correction based on a received gamma reference voltage.

Likewise, the timing controller 25, at a subsequent time section, controls the gate drivers 231, 232, 233, 234 to actuate the thin film transistors 2171 in the display sub-area 218 of the display areas 211, 212, 213, 214, 215, 216. The timing controller 25 then outputs green-color display data to the source drivers 221, 222, 223, and controls the gamma reference voltage generator 24 such that a set of gamma reference voltage relevant to the green-color display data can be supplied to the source drivers 221, 222, 223, so that the source drivers 221, 222, 223 can output the green-color display data to the green-color display sub-area 118 of the display areas 211, 212, 213, 214, 215, 216 after a gamma correction based on a received gamma reference voltage.

Similarly, the timing controller 25, at a further time section, proceeds with a gamma correction for the blue-color display data, and controls the gate drivers 231, 232, 233, 234 to actuate the thin film transistors 2171 in the display sub-area 219 of the display areas 211, 212, 213, 214, 215, 216. The timing controller 25 then outputs blue-color display data to the source drivers 221, 222, 223, and controls the gamma reference voltage generator 24 such that a set of gamma reference voltage relevant to the blue-color display data can be supplied to the source drivers 221, 222, 223, so that the source drivers 221, 222, 223 can output the blue-color display data to the blue-color display sub-area 219 of the display areas 211, 212, 213, 214, 215, 216 after a gamma correction based on a received gamma reference voltage.

Table 1 and Table 2 show, respectively, a timing sequence for the conventional LCD display panel module and a timing sequence for the LCD display module according to the present embodiment. In comparison, VESA Standard 1360×768, at 60 Hz, is exemplified.

TABLE 1

| 1360 RGB × 768, 60 Hz | | |
|---|---|---|
| Horizontal (Hor) Total Time | 1792 | Pixels |
| Hor Active Time | 1360 | Pixels |
| Hor Frequency | 47.712 | KHz |
| | 21 | μs/line |
| Vertical (Ver) Total Time | 795 | Lines |
| Ver Active Time | 768 | Lines |
| Ver Frequency | 60.015 | Hz |
| | 16.7 | ms/frame |
| Pixel Frequency | 85.5 | MHz |

TABLE 2

| 768 RGB × 1360, 60 Hz | | |
|---|---|---|
| Horizontal (Hor) Total Time | 795 | Pixels |
| Hor Active Time | 768 | Pixels |
| Hor Frequency | 107.51 | KHz |
| | 9.3 | μs/line |
| Vertical (Ver) Total Time | 1792 | Lines |
| Ver Active Time | 1360 | Lines |
| Ver Frequency | 60.015 | Hz |
| | 16.7 | ms/frame |
| Pixel Frequency | 85.5 | MHz |

As shown in Table 1 and Table 2, it is understood that the time required for the source drivers 221, 222, 223 to charge the thin film transistors 2171 in the display sub-areas 217, 218, 219 can be shortened from the original 21 μs to 9.3 μs. In addition, if an abnormal situation occurs at an insufficient charging rate to the thin film transistors 2171, a measure of "dual-side input" can be performed through the source drivers 221, 222, 223 so as to raise efficiency of charge up to a double amount equivalent to having charged for a double time, i.e. 18.6 μs. In contrast to an operation frequency 47.712 kHz for conventional gate drivers, the gate drivers 231, 232, 233, 234 according to the present embodiment can be increased to 107.51 kHz.

It is therefore noted that according to the present embodiment, by changing the terminal input locations of the source drivers and of the gate drivers, and using the storing device for the timing controller to register the multi-color display data groups so as to change the sort and arrangement thereof, such that the single-color display data groups can be output to the source drivers. Further, the gamma reference voltage generator can be actuated such that a set of gamma reference voltage relevant to the single-color display data groups can be supplied to the source drivers, so that the source drivers can correct the gamma reference voltage for the single-color display data groups, and that the single-color display data groups can be transmitted to the display panel correspondingly at the display sub-areas 217, 218, 219. As such, although the internal circuits of the source drivers and the structure of the display panel are not to be altered, various settings of gamma curves can still be performed based on different colors.

Figure 4A:
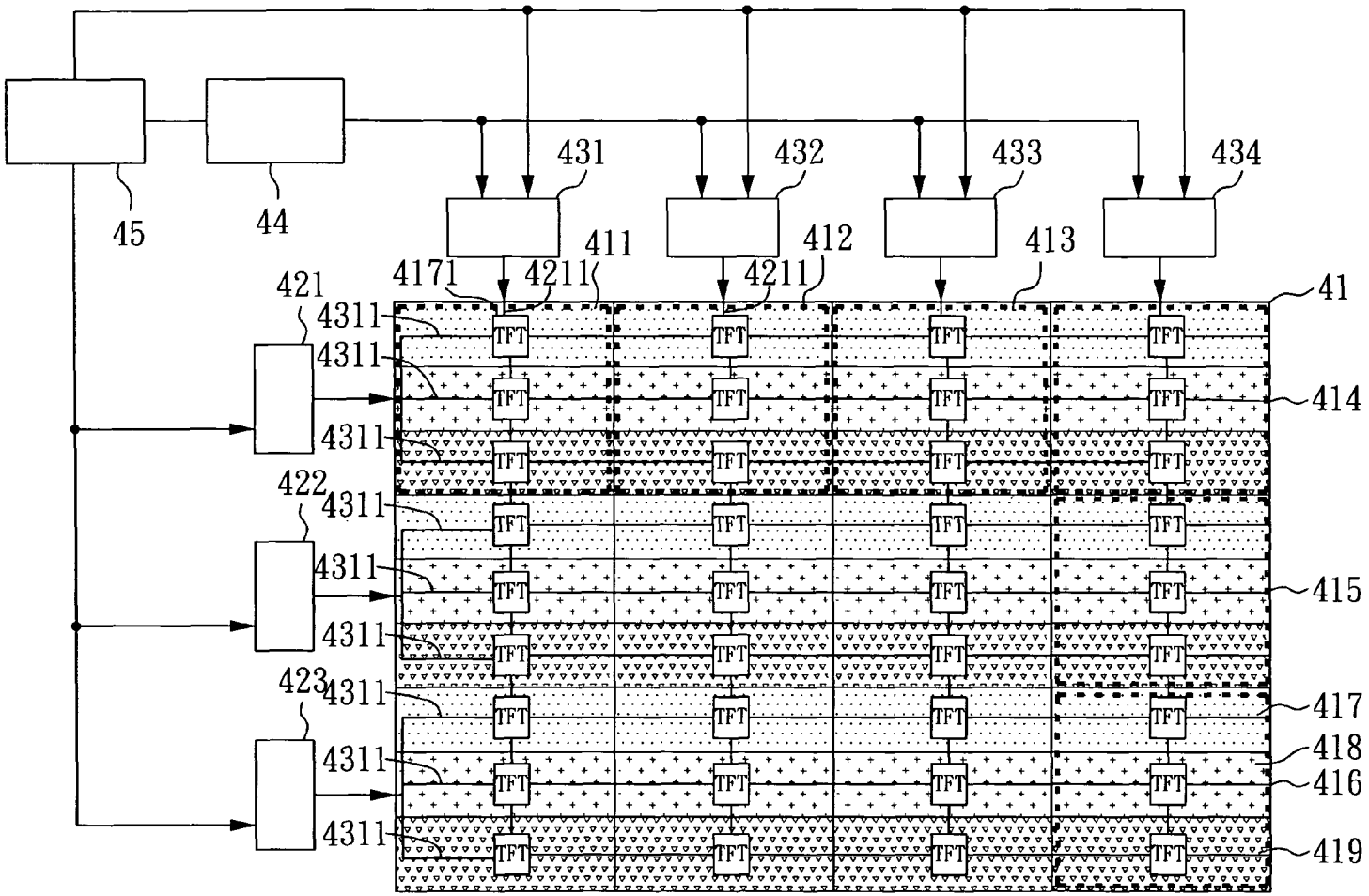
FIG. 4A is a schematic view illustrating an LCD panel module according to a second embodiment of the present invention.

The second embodiment of the present invention will be described with reference to FIGS. 4A and 4B, in which FIG. 4A is a schematic view illustrating an LCD panel module. The LCD panel module comprises a display panel 41, a plurality of gate drivers 421, 422, 423, a plurality of source drivers 431, 432, 433, 434, a gamma reference voltage generator 44, and a timing controller 45. The display panel 41 comprises a plurality of display areas 411, 412, 413, 414, 415, 416 each of which has a red display sub-area 417, a green display sub-area 418 and a blue display sub-area 419, wherein each of the display sub-areas 417, 418, 419 has a thin film transistor 4171 connected to the gate drivers 421, 422, 423 through source lines 4311 and connected to the source drivers 431, 432, 433, 434 through gate lines 4211. The layout of the thin film transistor 4171, gate lines 4211, and source lines 4311 may vary due to variable considerations, however, the present embodiment merely offers an example of the layouts.

The timing controller 45 is electrically connected with the gate drivers 421, 422, 423, the source drivers 431, 432, 433, 434, and the gamma reference voltage generator 44. The gamma reference voltage generator 44 is electrically connected with the source drivers 431, 432, 433, 434. The gate drivers 421, 422, 423 and the source drivers 431, 432, 433, 434 are electrically connected with the display areas 411, 412, 413, 414, 415, 416 of the display panel 41, respectively.

Notice may also be taken to the present embodiment, where the source drivers 431, 432, 433, 434 are arranged laterally beside the display panel 41; while the gate drivers 421, 422, 423 are arranged longitudinally beside the display panel 41.

Figure 4B:
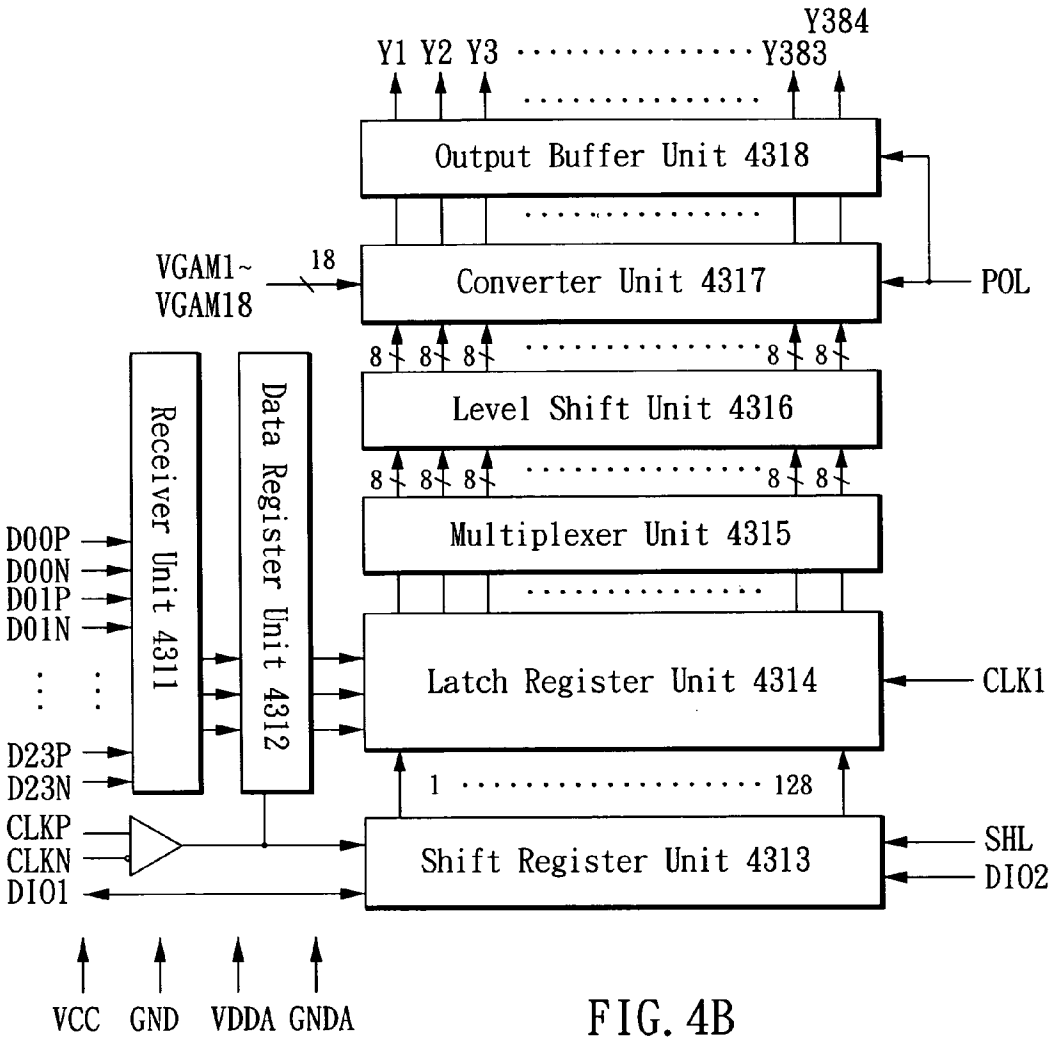
FIG. 4B is a function block diagram illustrating a source driver for the second embodiment of the present invention.

Further, explanation is given to FIG. 4B illustrating the function block diagram for the source drivers. As shown, the source drivers 431, 432, 433, 434 each comprises a receiver unit 4311, a data register unit 4312, a shift register unit 4313, a latch register unit 4314, a multiplexer unit 4315, a level shift unit 4316, a converter unit 4317, and an output buffer unit 4318. The receiver unit 4311 is electrically connected with the timing controller 45; the data register unit 4312 is electrically connected with the receiver unit 4311; the shift register unit 4313 is electrically connected with the data register unit 4312; the latch register unit 4314 electrically connects the data register unit 4312 with the shift register unit 4313; the multiplexer unit 4315 is electrically connected with the latch register unit 4314; the level shift unit 4316 is electrically connected with the multiplexer unit 4315; the converter unit 4317 is electrically connected with the level shift unit 4316; and the output buffer unit 4318 electrically connects the converter unit 4317 with the display sub-areas 417, 418, 419.

A communication interface supported by the receiver unit 4311 is determined by a communication interface supported by an output unit (not shown) of the timing controller 45 corresponding to the receiver unit 4311. A communication interface supported by a receiver unit 4311 however, is identical to the communication interface supported by the output unit. In the present embodiment, the receiver unit 4311 supports a reduced swing differential signal interface, for example, produced by National Semiconductor. The receiver unit 4311 provides communication between the source drivers 431, 432, 433, 434 and the timing controller 45, where the receiver unit 4311, through reduced swing differential signal lines (D00p-D23N), receives the multi-color display data output groups from the timing controller 45, and then transmits the display data groups to the data register unit 4312 for temporary storage.

The data register unit 4312 consists of a plurality of flip-flops (not shown) and of logic gates (not shown) so as to receive and register the multi-color display data groups output from the receiver unit 4311 and to transmit the multi-color display data groups to the latch register unit 4314. In the present embodiment, the amount of display data group output from the data register unit 4312 in one time section equals to the amount of data stored in the display sub-areas 417, 418, 419 connected, through a gate line4211, with the display panel 41. An example may be made to a display panel having a resolution of 1024*768, the amount of display data group transmitted at the previous time section was 1024*3 (red, green, blue three colors). In other embodiments, the amount of display data group transmitted at every time section may be different from one another.

Further, the shift register unit 4313, based on the differential timing signal transmitted from the timing controller 45, carries out a process of shifting, storage, signal conversion, and delay on the differential timing signal, and then outputs a set of the processed timing signal to the latch register unit 4314.

The latch register unit 4314, in compliance with the timing signal transmitted from the shift register unit 4313, registers or delays the display data groups transmitted from the data register unit 4312, and then transmits the display data groups to the multiplexer unit 4315. According to the present embodiment, the latch register unit 4314 can store an amount of display data that the display sub-areas 417 418, 419 can store, where the former is connected with the latter through two gate lines 4211. As such, the latch register unit 4314 can provide space for storing the display data groups transmitted from the data register unit 4312 in between two different time sections, i.e. the previous time section and the present time section.

The multiplexer 4315, based on a timing signal (not shown) transmitted from the timing controller 45, changes the sort and arrangement of the multi-color display data groups transmitted from the latch register unit 4314, so that the display data groups mixed with red, green and blue can be divided into single-color display data groups which then are output to the level shift unit 4316.

To facilitate transmitting the display data groups to the display sub-areas 417, 418, 419, the level shift unit 4316 adjusts the voltage level of the single-color display data groups transmitted from the multiplexer 4315, and transmits the adjusted display data groups to the converter unit 4317, where the converter unit 4317 converts the received single-color display data groups from a digital format into an analog format which is then transmitted to the output buffer unit 4318 for temporal storage, and thereafter to the display sub-areas 417, 418, 419 through the source lines 4311 of the display panel 41.

The timing controller 45, in compliance with the timing sequence of the single-color display data groups transmitted from the source drivers 431, 432, 433, 434, controls operation of the gamma reference voltage generator 44, such that a set of gamma reference voltage relevant to the presently output display data can be supplied to the source drivers 431, 432, 433, 434, so that the source drivers can proceed with a gamma correction in accordance with the received gamma reference voltage, and that the single-color display data then are transmitted to the display sub-areas 417/418/419 correspondingly at the display areas 411, 412, 413, 414, 415, 416.

Figure 5A:
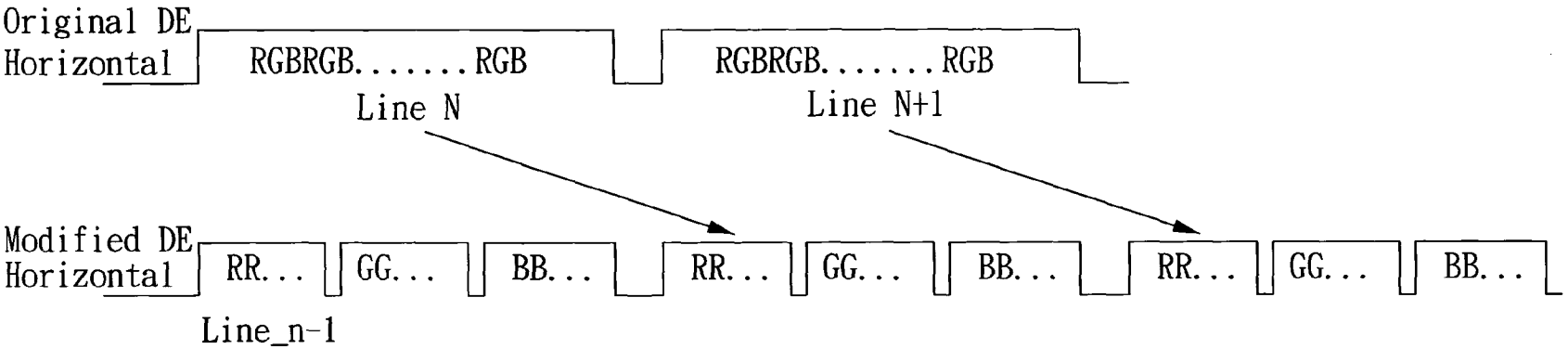
FIG. 5A is a schematic view illustrating operation timing for the second embodiment of the present invention.
Figure 5B:
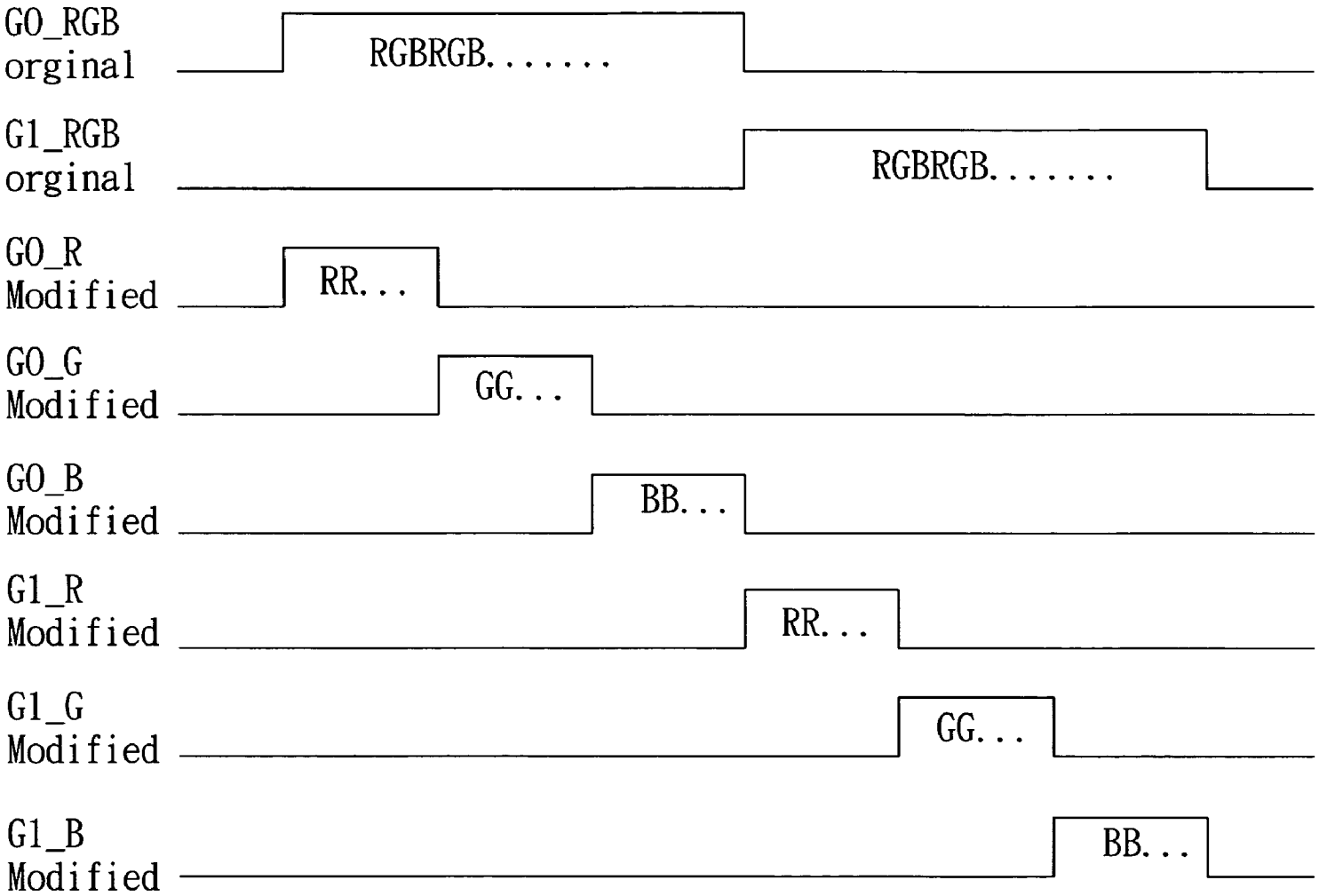
FIG. 5B is a schematic view illustrating output signal timing of gate drivers according to the second embodiment of the present invention.

FIGS. 5A and 5B are schematic views illustrating, respectively, operation timing and output signal timing of gate drivers according to the second embodiment. As shown, the display data groups transmitted to the source lines have been modified on sort and arrangement through the source drivers, and divided into single-color display data groups of various colors (Modified DE Horizontal). In contrast to the conventional display data groups transmitted to the source lines, which are multi-color display data groups mixed with red, green and blue (Original DE Horizontal).

Table 3 shows a timing sequence for the LCD display module according to the present embodiment, wherein VESA Standard 1360×768, at 60 Hz, is exemplified.

TABLE 3

| 1360 RGB × 768, 60 Hz | | |
|---|---|---|
| Horizontal (Hor) Total Time | 1792 | Pixels |
| Hor Active Time | 1360 | Pixels |
| Hor Frequency | 143.136 | KHz |
| | 7 | μs/line |
| Vertical (Ver) Total Time | 2331 | Lines |
| Ver Active Time | 2304 | Lines |
| Ver Frequency | 60.015 | Hz |
| | 16.7 | ms/frame |
| Pixel Frequency | 85.5 | MHz |

As shown in Table 3, it is understood that the time required for the source drivers 431, 432, 433, 434 to charge the thin film transistors 4171 in the display sub-areas 417, 418, 419 can be shortened as much as to one third down to 7 μs. In addition, if an abnormal situation occurs at an insufficient charging rate to the thin film transistors 4171, a measure of "dual-side input" can be performed through the source drivers 431, 432, 433, 434 so as to raise the efficiency of charge. In contrast to an operation frequency 47.712 kHz for conventional gate drivers, as shown in Table 1, the gate drivers 421, 422, 423 according to the present embodiment can be increased thrice up to 143.136 kHz.

It is therefore noted that the present embodiment provides a design for the source drivers so as to modify the sort and arrangement of the multi-color display data groups transmitted from the timing controller, such that the single-color display data groups can be output to the single-color display sub-areas 417/418/419 of the display panel, and that various settings of gamma curves can be performed based on different colors.

Figure 6A:
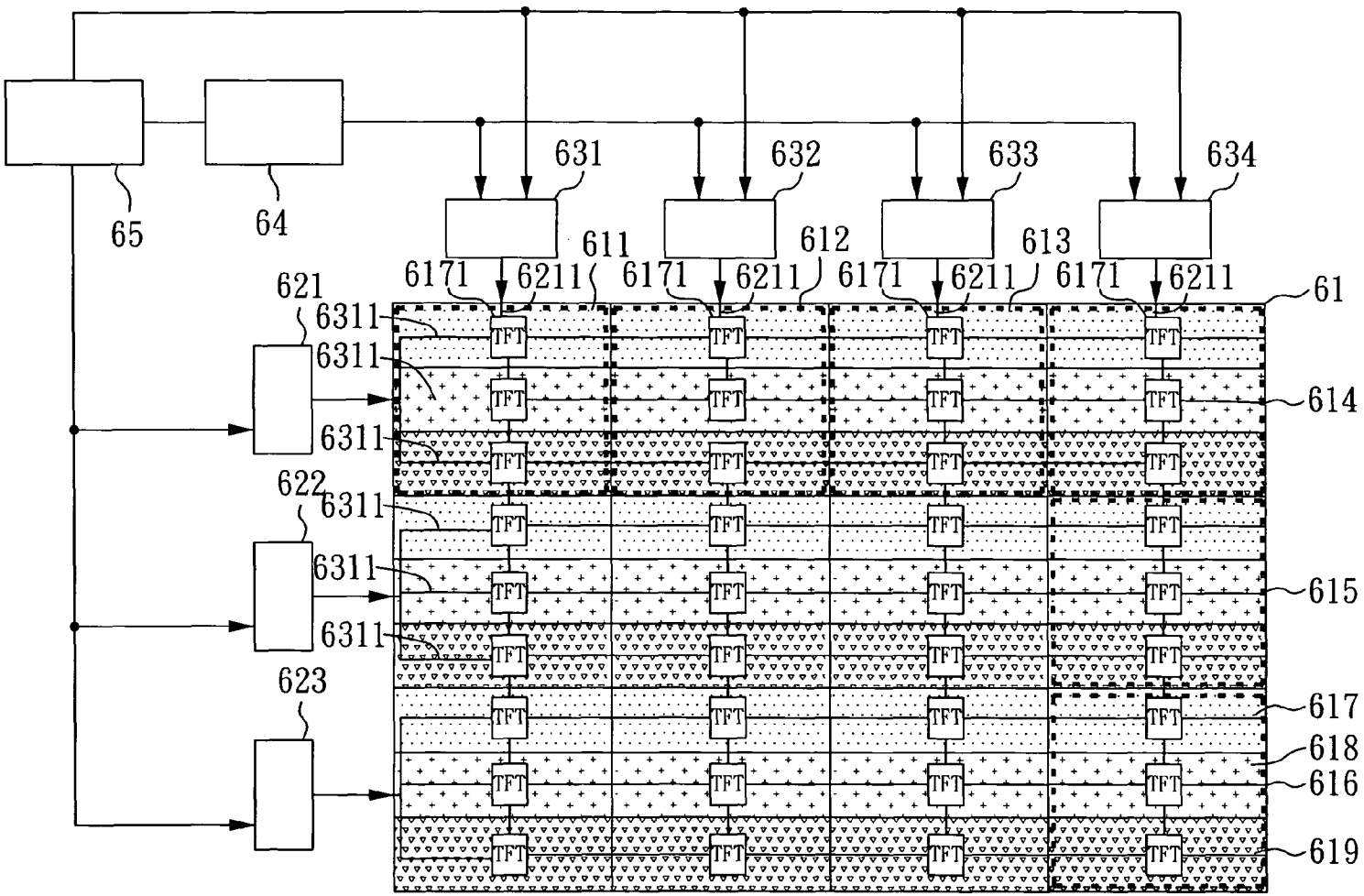
FIG. 6A a schematic view illustrating an LCD panel module according to a third embodiment of the present invention.

The third embodiment of the present invention, providing a timing controller for outputting single-color display data groups to the source drivers, will be described with reference to FIGS. 6A and 6B. FIG. 6A is a schematic view illustrating an LCD panel module, which comprises a display panel 61, a plurality of gate drivers 621, 622, 623, a plurality of source drivers 631, 632, 633, 634, a gamma reference voltage generator 64, and a timing controller 65. The display panel 61 comprises a plurality of display areas 611, 612, 613, 614, 615, 616 each of which has a red display sub-area 617, a green display sub-area 618 and a blue display sub-area 619, wherein each of the display sub-areas 617, 618, 619 has a thin film transistor 6171 connected to the gate drivers 621, 622, 623 through source lines 6311 and connected to the source drivers 631, 632, 633, 634 through gate lines 6211. The layout of the thin film transistor 6171, gate lines 6211, and source lines 6311 may vary due to variable considerations, however, the present embodiment merely offers an example of the layouts.

The timing controller 65 is electrically connected with the gate drivers 621, 622, 623, the source drivers 631, 632, 633, 634, and the gamma reference voltage generator 64. The gamma reference voltage generator 64 is electrically connected with the source drivers 631, 632, 633, 634. The gate drivers 621, 622, 623 and the source drivers 631, 632, 633, 634 are electrically connected with the display areas 611, 612, 613, 614, 615, 616 of the display panel 61, respectively.

Notice may also be taken to the present embodiment, where the source drivers 631, 632, 633, 634 are arranged laterally beside the display panel 61; while the gate drivers 621, 622, 623 are arranged longitudinally beside the display panel 61.

Figure 6B:
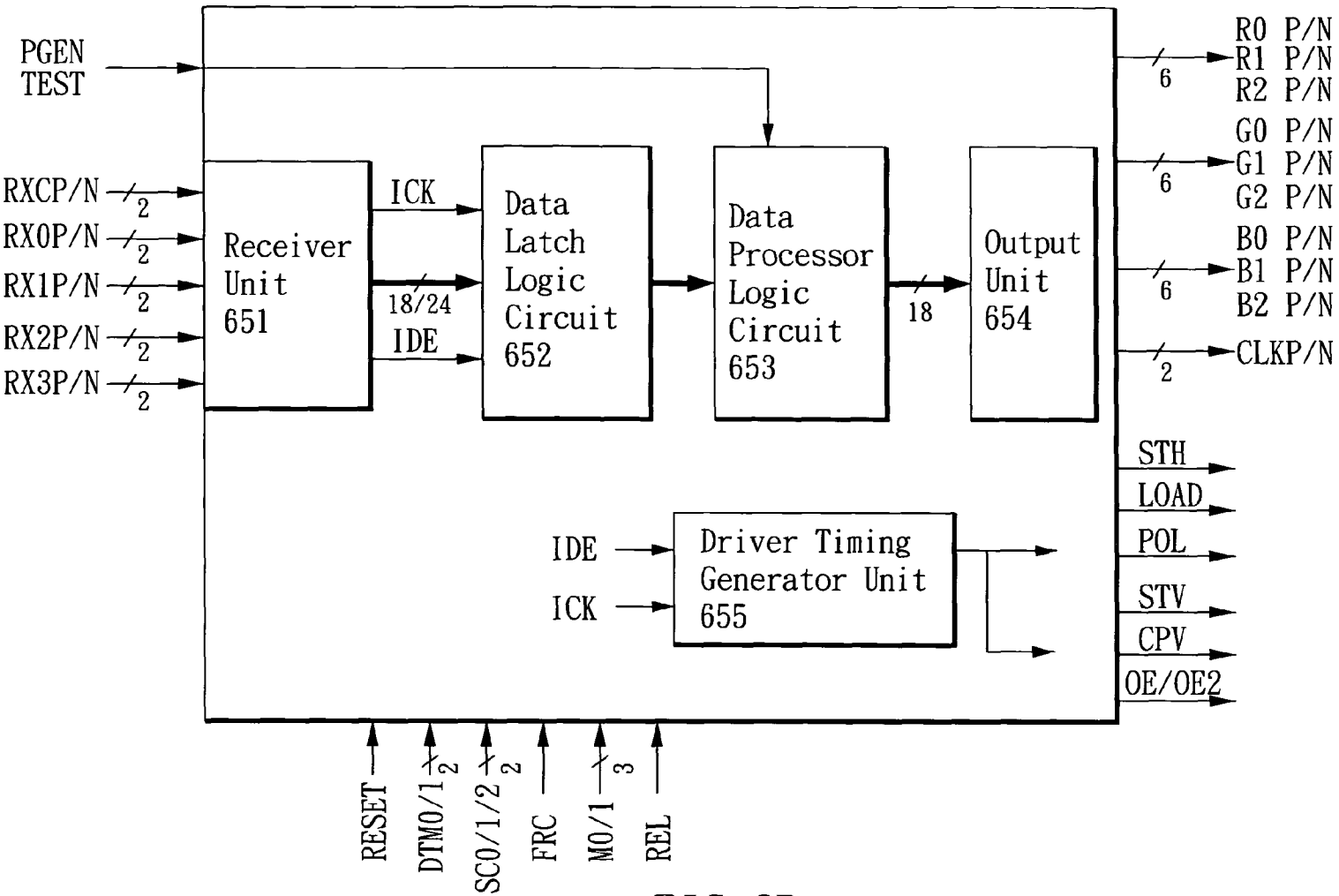
FIG. 6B is a function block diagram illustrating a timing controller for the third embodiment of the present invention.

Further, explanation is given to FIG. 6B illustrating a function block diagram for the timing controller 65. As shown, the timing controller 65 comprises a receiver unit 651, a data latch logic circuit 652, a data process logic circuit 653, an output unit 654, and a driver timing generator unit 655. The data latch logic circuit 652 is electrically connected with the receiver unit 651; the data process logic circuit 653 is electrically connected with the data latch logic circuit 652; the output unit 654 is electrically connected with and among the data process logic circuit 653, the source drivers 631, 632, 633, 634 and the gate drivers 621, 622, 623; and the driver timing generator unit 655 is electrically connected with and among the receiver unit 651, the source drivers 631, 632, 633, 634 and the gate drivers 621, 622, 623.

A communication interface supported by the receiver unit 651 is determined by a communication interface supported by a unit disposed in the external device connected with the receiver unit 651. The communication interface supported by the receiver unit 651, however, is identical to the communication interface supported by the unit disposed in the external device. In the present embodiment, the receiver unit 651 supports a low voltage differential signal interface, and receives multi-color display data groups from the external device, through a differential timing line (RXCP/N) and differential channel lines (RX0P/N, RX1P/N, RX2P/N and RX3P/N), and converts the display data groups into a logic format; and thereafter transmits an internal timing signal (ICK), an internal data enabling signal (IDE) and the multi-color display data groups (Data) to the data latch logic circuit 652.

The data latch logic circuit 652 registers the internal timing signal (ICK), the internal data enabling signal (IDE) and the multi-color display data groups (Data), which were received from the receiver unit 651, and then transmits the same to the data process logic circuit 653 for further process. According to the present embodiment, the data latch logic circuit 652 can store an amount of display data that the display sub-areas 617, 618, 619 can store, where the former is connected with the latter through two gate lines 6211. As such, the data latch logic circuit 652 can provide space for storing the display data groups transmitted from the receiver unit in between two different time sections, i.e. the previous time section and the present time section.

After the data process logic circuit 653 has received the multi-color display data groups from the data latch logic circuit 652, the sort and arrangement of the multi-color display data groups are modified so as to distinguish display data groups of various colors into single-color display data groups, and to transmit the display data groups to the output unit 654.

The output unit 654 transmits the single-color display data groups, which are transmitted from the data process logic circuit 653, to the source drivers 631, 632, 633, 634, where the source drivers 631, 632, 633, 634 further outputs the single-color display data groups to the display sub-areas 617/618/619 which have the same color as that of the single-color display groups, in the display areas 611, 612, 613, 614, 615, 616. A communication interface supported by the output unit 654 is determined by a communication interface supported by a unit (not shown) which is disposed in the source drivers 631, 632, 633, 634, or in the gate drivers 621, 622, 623, and is electrically connected with the output unit 654. The communication interface supported by the output unit 654 is the same interface as that of the unit disposed in the source drivers 631, 632, 633, 634, or in the gate drivers 621, 622, 623. In the present embodiment, the output unit 654 supports a reduced swing differential signal interface.

Further, the driver timing generator unit 655 receives, from the receiver unit 651, the internal timing signal and the internal data enabling signal so as to produce a timing controlling signal, and to output the same to, and control the operation of, the gate drivers 621, 622, 623 and the source drivers 631, 632, 633, 634.

Therefore, the timing controller 65 transmits display data groups which are of a single color to the source drivers 631, 632, 633, 634, and controls the operation of a gamma reference voltage generator 64, such that a set of gamma reference voltage relevant to the color of the display data groups can be supplied to the source drivers 631, 632, 633, 634, so that the source drivers 631, 632, 633, 634 can proceed with a gamma correction based on the received gamma reference voltage. The single-color display data groups are then transmitted to the display sub-areas 617, 618, 619, which correspond to the single-color display data groups, in the display areas 611, 612, 613, 614, 615, 616.

Still further, since the timing sequence for the LCD display module according to the present embodiment is identical with the timing sequence for the LCD display module according to the second embodiment, as shown in Table 3, there is no need to repeat the same redundantly.

It is understood that the present embodiment provides a design for the timing controller so as to modify the sort and arrangement of the multi-color display data groups mixed with a variety of colors, which are received from the external device, so that single-color display data groups can be obtained. Thereafter, the single-color display data groups are transmitted to the source drivers, through which the single-color display data groups are transmitted to the display sub-areas in the display panel, such that various settings of gamma curves can be performed based on different colors.

According to the present invention, the display data groups transmitted, at one time section, to the display sub-areas in the display panel are of a single color, so that the gamma reference voltage generator, based on the single color, produces a set of gamma reference voltage for the source drivers as a gamma correction, such that an optimal correction effectiveness can be obtained.

Although the present invention has been explained in relation to its preferred embodiments, it is to be understood that many other possible modifications and variations can be made without departing from the scope of the invention as hereinafter claimed.

What is claimed is:

1. An LCD display panel module, comprising:

a display panel, including a plurality of display areas each of which has a plurality of display sub-areas;

a plurality of source drivers, electrically connected with the display panel and located at a first side of the display panel for outputting single-color display data groups to corresponding display sub-areas of each display area in the display panel, wherein all the signals in each single-color display data group are of the same color corresponding to the display sub-areas of the same color in the display panel, such that, when a single-color display data group is received by a receiver unit included in each source driver, the source drivers output a single color corresponding to the single-color display data group at every time section for outputting display data of the single color to the display panel;

a plurality of gate drivers, electrically connected with the display panel, and located at a second side of the display panel;

a gamma reference voltage generator, electrically connected with the source drivers; and a timing controller, electrically connected with the source drivers, the gate drivers, and the gamma reference voltage generator, and for controlling operation of the gate drivers, of the source drivers, and of the gamma reference voltage generator, such that a set of gamma reference voltages corresponding to each single-color display data group can be supplied to the source drivers from the gamma reference voltage generator;

wherein a communication interface supported by the receiver unit is determined by and identical to a communication interface supported by an output unit of the timing controller corresponding to the receiver unit, and the timing controller controls additionally the gamma reference voltage generator such that a set of gamma reference voltage relevant to the output single-color is supplied to the source drivers, so that the source drivers correct the gamma reference voltage for the single-color display data groups; and wherein each of the display sub-areas comprises a thin-film transistor, and the source drivers charge the thin-film transistors by a dual-side input.

2. The LCD display panel module as claimed in claim 1, wherein the display sub-areas are in a vertical arrangement when the first side of the display panel is a longitudinal side and the second side of the display panel is a lateral side, and the first side is perpendicular to the second side.

3. The LCD display panel module as claimed in claim 2, wherein at least one gate driver controls longitudinally the display sub-areas; and at least one source driver provides laterally the single-color display data groups corresponding to the set of gamma reference voltage to the display sub-areas.

4. The LCD display panel module as claimed in claim 2, wherein the gate drivers have an amount of output channels more than those of the source drivers.

5. The LCD display panel module as claimed in claim 2, further comprising a storing device electrically connected with the timing controller, wherein the storing device receives multi-color display data groups from the timing controller; and wherein the timing controller, by using the storing device, changes the sort and arrangement of the multi-color display data groups so as to transmit single-color display data groups to the source drivers.

6. The LCD display panel module as claimed in claim 5, wherein the storing device is a Synchronous DRAM.

7. The LCD display panel module as claimed in claim 1, wherein the display sub-areas are in a horizontal arrangement when the first side of the display panel is a lateral side and the second side of the display panel is a longitudinal side, and the first side is perpendicular to the second side.

8. The LCD display panel module as claimed in claim 7, wherein at least one gate driver controls laterally the display sub-areas; and at least one source driver provides longitudinally the single-color display data groups to the display sub-areas.

9. The LCD display panel module as claimed in claim 7, wherein the source driver comprises:

the receiver unit, electrically connected with the timing controller for receiving multi-color display data groups from the timing controller;

a latch register unit, electrically connected with the receiver unit for registering the multi-color display data groups;

a multiplexer unit, electrically connected with the latch register unit for changing the sort and arrangement of the multi-color display data groups so as to produce single-color display data groups; and an output buffer unit, electrically connecting the multiplexer unit with the display sub-areas for buffering the single-color display data groups which are then transmitted to corresponding sub-areas in the display panel.

10. The LCD display panel module as claimed in claim 9, wherein the source driver further comprises:

a data register unit, electrically connecting the receiver unit with the latch register unit;

a shift register unit, electrically connecting the data register unit with the latch register unit;

a converter unit, electrically connected with the output buffer unit; and a level shift unit, electrically connecting the multiplexer unit with the converter unit.

11. The LCD display panel module as claimed in claim 9, wherein the receiver unit supports a reduced swing differential signal interface, a transistor-transistor logic interface, or a low voltage differential signal interface.

12. The LCD display panel module as claimed in claim 9, wherein the display panel further comprises a plurality of gate lines connected with the gate drivers and the display sub-areas; and wherein the data latch logic circuit stores the amount of the data as the amount of the data stored in the display sub-areas connected with the gate lines.

13. The LCD display panel module as claimed in claim 9, wherein the multiplexer is a 3:1 multiplexer.

14. The LCD display panel module as claimed in claim 7, wherein the timing controller comprises:

a receiver unit for receiving a plurality of multi-color display data groups;

a data latch logic circuit, electrically connected with the receiver unit for registering the multi-color display data groups;

a data process logic circuit, electrically connected with the data latch logic circuit for changing the sort and arrangement of the multi-color display data groups so as to produce a plurality of single-color display data groups; and an output unit, electrically connecting the data process logic circuit with the source drivers for transmitting the single-color display data groups to the source drivers, and thereafter the source drivers transmitting the single-color display data groups to the corresponding display sub-areas in the display panel.

15. The LCD display panel module as claimed in claim 14, wherein the timing controller further comprises a driver timing generator unit for producing a plurality of timing signals to the source drivers and the gate drivers.

16. The LCD display panel module as claimed in claim 14, wherein the receiver unit or the output unit supports a reduced swing differential signal interface, a transistor-transistor logic interface, or a low voltage differential signal interface.

17. The LCD display panel module as claimed in claim 14, wherein the display panel further comprises a plurality of gate lines which are connected with the grate drivers and the display sub-areas, and wherein the data latch logic circuit stores the amount of the data as the amount of the data stored in the display sub-areas which are connected with the gate lines.

18. The LCD display panel module as claimed in claim 1, wherein the source driver comprises:

a receiver unit, electrically connected with the timing controller for receiving from the timing controller multi-color display data groups;

a latch register unit, electrically connected with the receiver unit for registering the multi-color display data groups;

a multiplexer unit, electrically connected with the latch register unit for changing the sort and arrangement of the multi-color display data groups so as to produce single-color display data groups, and an output buffer unit, electrically connecting the multiplexer unit with the display sub-areas for registering the single-color display data groups with are then transmitted to corresponding sub-areas in the display panel.

19. The LCD display panel module as claimed in claim 1, wherein the timing controller comprises:

a receiver unit for receiving multi-color display data groups;

a data latch logic circuit, electrically connected with the receiver unit for registering the multi-color display data groups;

a data process logic circuit, electrically connected with the data latch logic circuit for changing the sort and arrangement of the multi-color display data groups so as to produced single-color display data groups; and an output unit, electrically connecting the data process logic circuit with the source drivers for transmitting the single-color display data groups to the source drivers.

* * * * *